US011203911B1

(12) United States Patent
Rogers et al.

(10) Patent No.: US 11,203,911 B1
(45) Date of Patent: Dec. 21, 2021

(54) STAGE PACKER SHOE WITH A METAL CUP SYSTEM AND METHOD OF USE

(71) Applicants: Henry E. Rogers, Houston, TX (US); Nicolas Rogozinski, Houston, TX (US)

(72) Inventors: Henry E. Rogers, Houston, TX (US); Nicolas Rogozinski, Houston, TX (US)

( * ) Notice: Subject to any disclaimer, the term of this patent is extended or adjusted under 35 U.S.C. 154(b) by 0 days.

(21) Appl. No.: 16/442,807

(22) Filed: Jun. 17, 2019

Related U.S. Application Data

(60) Provisional application No. 62/820,305, filed on Mar. 19, 2019.

(51) Int. Cl.

| | |
|---|---|
| ***E21B 33/126*** | (2006.01) |
| ***E21B 34/10*** | (2006.01) |
| ***E21B 33/12*** | (2006.01) |
| ***E21B 33/13*** | (2006.01) |
| ***E21B 33/14*** | (2006.01) |

(52) U.S. Cl.
CPC ..... *E21B 33/126* (2013.01); *E21B 33/1212* (2013.01); *E21B 33/13* (2013.01); *E21B 33/146* (2013.01); *E21B 34/10* (2013.01); *E21B 2200/06* (2020.05)

(58) Field of Classification Search
CPC .... E21B 21/10; E21B 21/103; E21B 33/1212; E21B 33/126; E21B 33/13; E21B 33/136; E21B 33/14; E21B 33/146
See application file for complete search history.

(56) References Cited

U.S. PATENT DOCUMENTS 5,732,775 A * 3/1998 Hudson ..... E21B 17/043 166/177.4

* cited by examiner

*Primary Examiner* — Tara Schimpf
(74) *Attorney, Agent, or Firm* — Leavitt Eldredge Law Firm

(57) ABSTRACT

A wellbore tool system for use within a wellbore includes a stage packer shoe, having a lower body extending from a first end to a second end; an upper body attached to the lower body at the second end; and circulation ports extending through a thickness of the upper body; a metal cup having a predetermined diameter as determined by a diameter of the wellbore; the metal cup secured around a periphery of the lower body of the stage packer shoe such that the metal cup extends away from the periphery; the metal cup is to engage with the wellbore enough to have differential pressure holding capability between the stage packer shoe and the wellbore; and the differential pressure of the metal cup is dependent on a strength of the cup and the wellbore with which the metal cup is engaged.

9 Claims, 5 Drawing Sheets

STAGE PACKER SHOE WITH A METAL CUP SYSTEM AND METHOD OF USE

BACKGROUND

1. Field of the Invention

The present invention relates generally to systems and methods for running and cementing casings in a wellbore and more specifically to a stage packer shoe tool with an integral metal cup that provides for an improved method of use.

2. Description of Related Art

Well drilling systems are well known in the art and are effective means to collect resources for energy use. For example, FIG. 1 depicts a flowchart 101 of a conventional well drilling operation. During use, a parent wellbore is first drilled to a desired depth before a casing string is run into the parent wellbore, wherein the casing string is run to a depth that is less than the total depth, thereby leaving a portion of exposed wellbore below the end of the casing string, as shown with boxes 103, 105. The casing string is used in connection with a seal tool that is configured to be activated within the wellbore to form a seal between the outside of the casing and the wellbore wall to prevent flow out the end of the casing into the wellbore below the casing, as shown with box 107. The tool (or a second tool) provides a flow path from inside of the casing to the annular space between the casing and parent wellbore above the seal, and circulating is performed to condition the annular space above the seal, as shown with box 109. Cement pumping operations can then be performed, wherein cement is pumped through the casing and into the annular space above the seal, the hydrostatic pressure of the cement being supported by the seal, thereby allowing the cement to be lifted to the surface, as shown with box 111. After the cementing operations, a closing device is conventionally utilized to convert the tool from an open to closed position, as shown with box 113. Pressure is released from the wellbore and the job is completed, as shown with box 115.

In this conventional methodology, the tool used to form the seal is commonly a compression set elastomer element or an inflation element, which are both considered costly options for many operations.

Accordingly, it is an object of the present invention to provide a system and method that improves well construction costs and thereby improves efficiency associated with wellbore construction. The system and method of the present invention provides a stage packer shoe tool with a metal cup secured around a periphery of the lower body of the tool, the metal cup providing an annular seal with improved wear resistance. This tool, along with the method of operation, is considered novel to the present invention.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
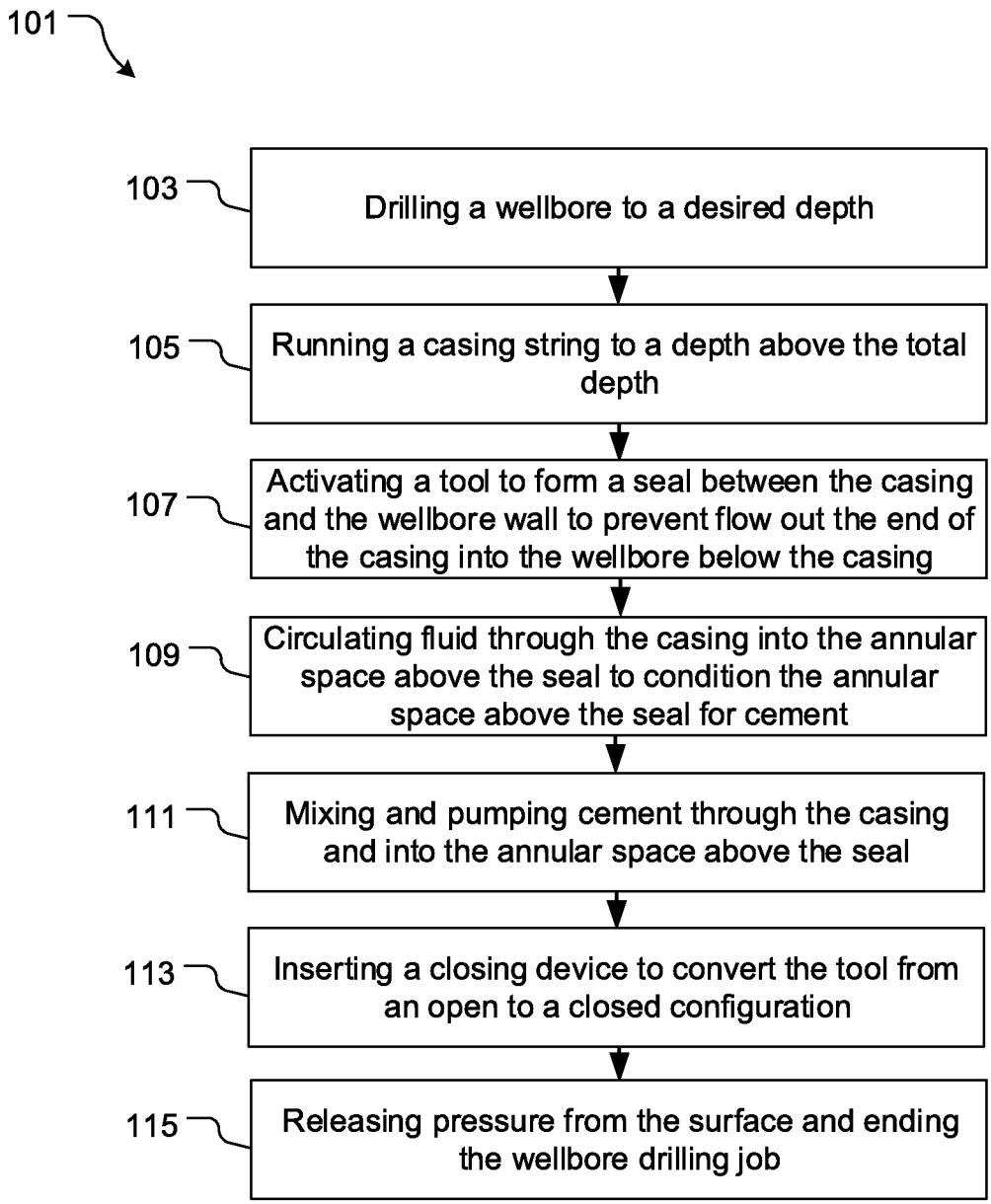
FIG. 1 (Prior Art)
FIG. 1 is a flowchart of a conventional method of wellbore drilling operations.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional well drilling operations. Specifically, the present invention provides a tool having a metal cup secured around a periphery to create an annular seal that is durable and economically advantageous. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
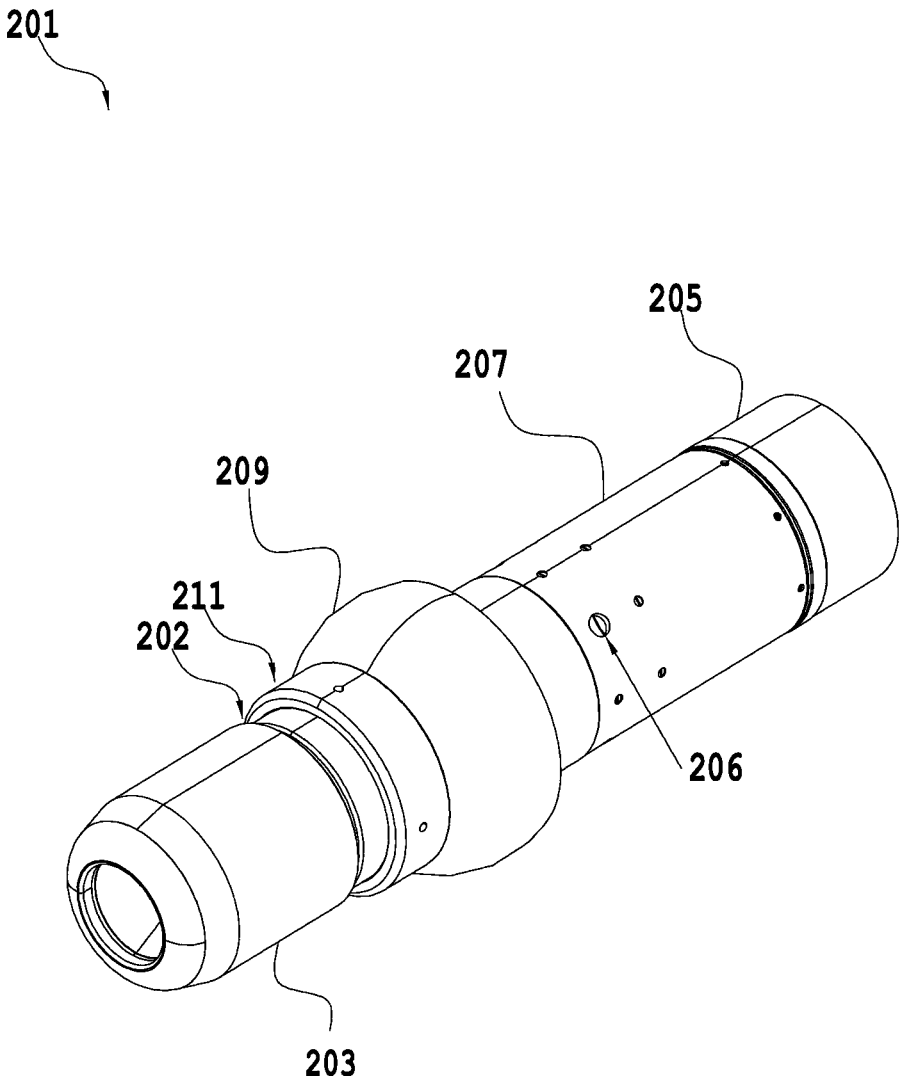
FIG. 2 is an isometric view of a stage packer shoe tool with a metal cup secured thereto in accordance with a preferred embodiment of the present application.

Referring now to the drawings wherein like reference characters identify corresponding or similar elements throughout the several views, FIG. 2 depicts an isometric view of a stage packer shoe tool 201 in accordance with a preferred embodiment of the present application. It will be appreciated that tool 201, along with the associated method, overcomes one or more of the above-listed problems commonly associated with conventional well drilling systems and methods.

In the preferred embodiment, tool 201 includes a lower body 202 extending from a first end to a second end and engaged with a guide nose 203 at a first end and engaged with an upper body 205 at the other end. It should be appreciated that the guiding nose, upper body, and lower body can vary. A portion 207 of the upper body includes a plurality of circulation ports 206 through which fluid can flow when in an open position. The plurality of circulation ports provides fluid communication between the inside of the tool and the annular space between the tool and the wellbore, thereby allowing for circulation operations and cementing operations.

One of the unique features believed characteristic of the present application is the incorporation of a metal cup 209 which is secured around a periphery of the tool above the nose 203 and extends away from the tool diameter. The metal cup 209 can be integrally secured to the lower body 202, or alternatively can be secured via a stop collar 211. The metal cup 209 provides for a plurality of benefits associated with the well drilling operations, including creating an annular seal with the formation cap rock that forces circulated fluid up the annulus of the wellbore.

It should be appreciated that the metal cup 209 is sized and manufactured to fit within the wellbore in which the tool will be run and have an interference fit created by the determined diameter of the metal cup needed. The metal cup 209 is configured to come into contact with the wellbore wall with enough force to create a seal within the wellbore, such that cement can be circulated above the metal cup. The design of the metal cup is such that increasing differential pressure across the element serves to increase the contact force the metal cup exerts on the wellbore wall, thereby increasing the differential pressure rating or capacity of the tool or assembly.

Figure 3A:
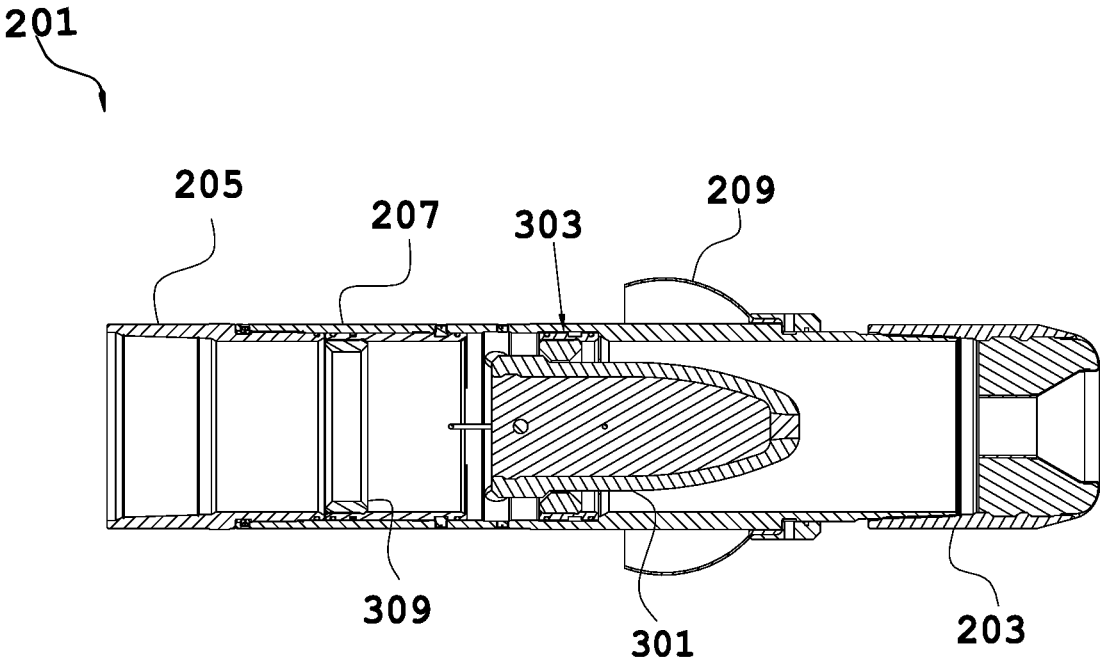
FIGS. 3A-3C are side cross-sectional views of the tool of FIG. 2 in various stages of operation.
Figure 3B:
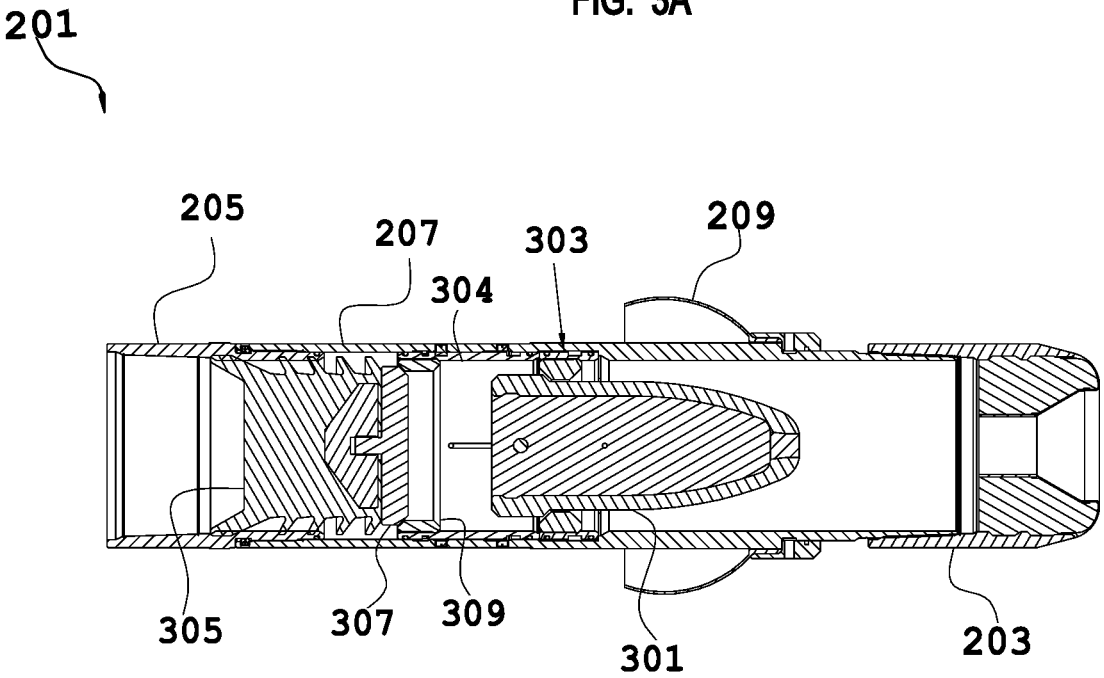
Figure 3C:
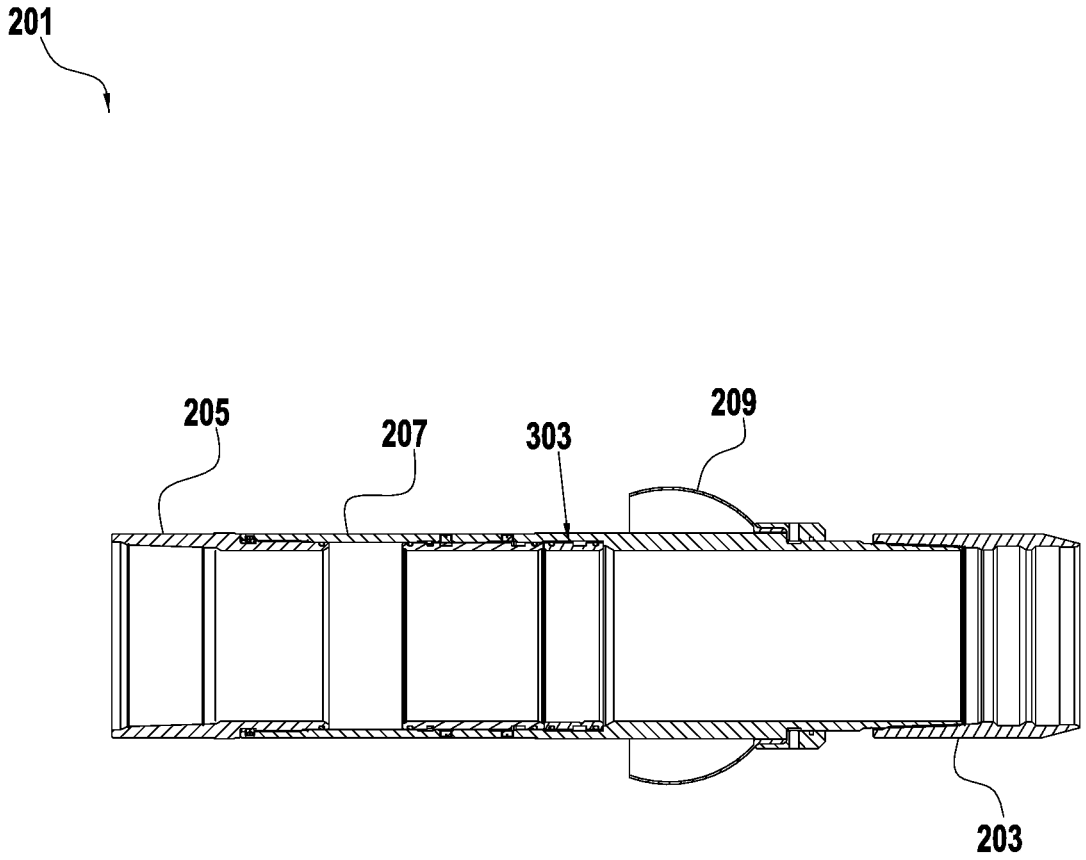

In FIGS. 3A-3C, the tool 201 is shown in various stages of use. Tool 201 is first attached to a casing string and run into a drilled wellbore to a desired depth, wherein the metal cup is located at a depth in the cap rock above the producing formation. It should be appreciated that in other embodiments, the tool is not run with the casing string. At this point, a freefall plug 301 is utilized. It should be appreciated that the freefall plug 301 can either be run in place with the tool, or alternatively, can be dropped from the surface as desired by the operator. The freefall plug 301 is configured to engage with a freefall plug seat 303 such that all fluid is forced through the circulation ports 206. The freefall plug can vary and can be a ball or other means that seals the inner diameter of the tool, thereby forcing flow through the circulation ports. In this configuration, shown in FIG. 3A, circulation through the tool is forced into the annular space above the metal cup, such as for wellbore conditioning prior to cementing operations.

As shown in FIG. 3B, the post job configuration of the tool 201 is shown. As shown, a closing plug 305 having a nose 307 is dropped from the user and configured to engage with a closing seat 309 such that the closing plug 305 seals off the plurality of circulation ports with a sleeve 304 being forced into place. As shown in FIG. 3C, after drillout operations, the freefall plug 301 and closing plug 305 are removed from the tool.

Figure 4:
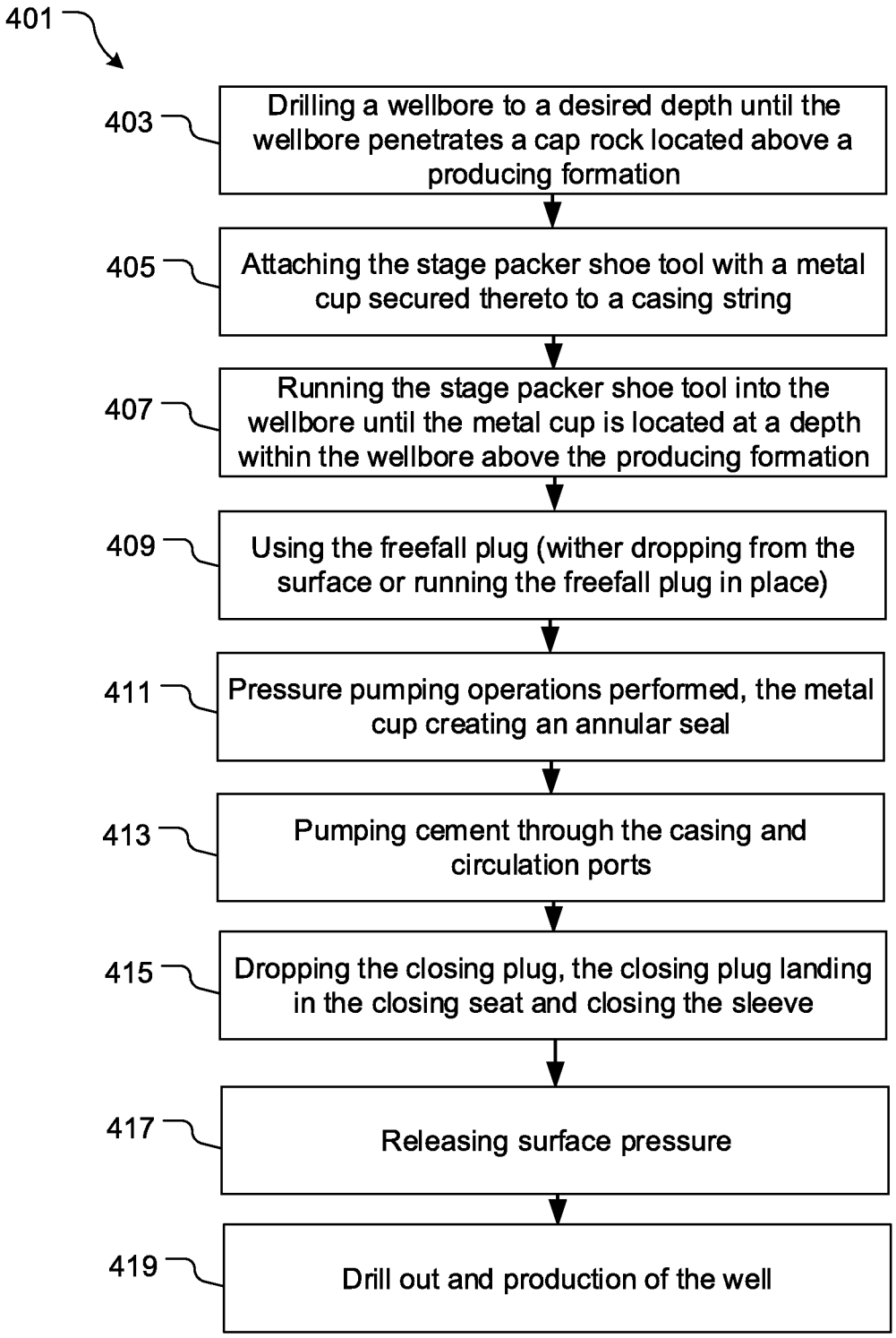
FIG. 4 is a flowchart of a method of use of the tool of FIG. 2.

In FIG. 4, a method of use of the stage packer shoe tool with metal cup of the present invention is shown in flowchart 401. During use, the wellbore is drilled to a desired depth until the wellbore penetrates a cap rock located above a producing formation, as desired by the operator, as shown with box 403. The stage packer shoe tool with metal cup is secured to a casing string and run to a depth wherein the metal cup is located at a depth within the wellbore above the producing formation, as shown with boxes 405, 407. A freefall plug, either run in place with the tool or dropped from the surface, is secured in a position with the freefall plug seat of the tool, as shown with box 409. Surface circulation equipment is attached to the casing and pumping operations are performed through the casing and circulation ports and into the annular space between the casing and the wellbore above the metal cup, as shown with box 411. It must be appreciated and understood that the metal cup forms an annular seal within the wellbore that forces the circulated fluid up the annulus, as desired. Cementing operations can then be performed through the casing, as shown with box 413. After completion of the cementing operations, the closing plug is dropped from the surface, wherein the closing plug engages with the closing plug seat to force the sleeve into a closed position, thereby sealing off the circulation ports, as shown with box 415. Surface pressure is release and drill out operations are performed, as is conventional in the art, as shown with boxes 417, 419.

It must be understood that the use of the metal cup around the periphery of the stage packer shoe, provides benefits and improved performance over the prior art. It is contemplated that more than one metal cup could be utilized as desired. In addition, it should be appreciated that the size and shape of the metal cup can vary as functional considerations require.

Some of the benefits of the tool and method of the present invention include: (1) the metal cup is durable and provides for an economical seal that is also wear resistant compared to conventional elastomer cups; (2) the metal cup allows for a short tool that can easily be located within very short cap tock sections of the well above the producing formation; (3) the configuration of the metal cup provides initial sealing capability because of the contact force with the formation compared to compression set sealing elements; and (4) the configuration and structural strength of the metal cup allows casing reciprocation or rotation during wellbore conditioning without damaging the metal cup.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wellbore tool system for use within a wellbore, comprising:

a stage packer shoe, having:

a lower body extending from a first end to a second end;

an upper body attached to the lower body at the second end, the upper body forming an inner area; and a plurality of circulation ports extending through a thickness of the upper body, the plurality of circulation ports are in fluid communication with the inner area;

a metal cup having a predetermined diameter as determined by a diameter of the wellbore;

the metal cup is secured around a periphery of the lower body of the stage packer shoe such that the metal cup extends away from the periphery;

a plug seat extending from an inner surface of the inner area, the plug seat forming an opening between the lower body and the upper body;

a first plug configured to engage with the plug seat and configured to close the opening, the first plug is configured to force all fluid through the plurality of circulation pores; and a second plug configured to engage with the upper body, the second plug is configured to cover the plurality of circulation ports;

wherein the metal cup is configured to engage with the wellbore enough to have differential pressure holding capability between the stage packer shoe and the wellbore; and wherein the differential pressure of the metal cup is dependent on a strength of the cup and the wellbore with which the metal cup is engaged.

2. The system of claim 1, wherein the metal cup is integrally secured to the periphery of the lower body.

3. The system of claim 1, wherein the metal cup is secured to the periphery of the lower body via a stop collar.

4. The system of claim 1, further comprising:

a guide nose attached to the lower body at the first end.

5. A method of wellbore operations, the method comprising:

providing the system of claim 1;

drilling the wellbore to a desired depth until the wellbore penetrates the cap rock located above the producing formation; and running the stage packer shoe tool into the wellbore until the metal cup is located at a depth within the wellbore above the producing formation;

wherein the metal cup creates an annular seal within the producing formation.

6. The method of claim 5, further comprising:

dropping a freefall plug from a ground surface into the stage packer shoe tool; wherein the freefall plug engages with a freefall plug landing seat positioned within lower body; and wherein the freefall plug forces fluid through a plurality of circulation ports extending through a thickness of the upper body.

7. The method of claim 6, further comprising:

performing one or more pumping operations through a wellbore casing.

8. The method of claim 7, further comprising:

inserting the second plug into the wellbore casing to engage with a closing seat of the stage packer shoe tool;

wherein engagement of the second plug with the closing seat closes a sleeve of the stage packer shoe tool.

9. The method of claim 8, further comprising:

releasing surface pressure from the wellbore and performing drill out operations.

* * * * *